US007465066B2

(12) United States Patent
Chen

(10) Patent No.: US 7,465,066 B2
(45) Date of Patent: Dec. 16, 2008

(54) WATER-RESISTANT ILLUMINATION APPARATUS

(76) Inventor: Chuen-Shing Chen, No. 71-2, Chuang-Chien Road, Chuang-Chien Tsun, Shen-Kang Hsiang, Taichung Hsien (TW)

( * ) Notice: Subject to any disclaimer, the term of this patent is extended or adjusted under 35 U.S.C. 154(b) by 445 days.

(21) Appl. No.: 11/357,138

(22) Filed: Feb. 21, 2006

(65) Prior Publication Data

US 2007/0133203 A1 Jun. 14, 2007

(51) Int. Cl.
*F21V 29/00* (2006.01)

(52) U.S. Cl. ..... 362/267; 362/230; 362/235; 362/294

(58) Field of Classification Search ..... 362/230, 362/231, 235, 241–249, 251, 218, 267, 268, 362/158, 294, 373, 311, 332, 399, 800
See application file for complete search history.

(56) References Cited

U.S. PATENT DOCUMENTS 6,161,910 A * 12/2000 Reisenauer et al. ..... 362/235
2004/0012953 A1* 1/2004 Clemente et al. ..... 352/158
2006/0067077 A1* 3/2006 Kumthampinij et al. .... 362/294

* cited by examiner

*Primary Examiner*—Bao Q Truong
(74) *Attorney, Agent, or Firm*—Steptoe & Johnson LLP

(57) ABSTRACT

An illumination apparatus includes a heat-conductive tubular housing. A lighting device includes: a heat dissipating plate positioned in the housing and disposed adjacent to an open front end of the housing; lighting units, each having a light emitting diode mounted on a circuit board in thermal contact with the heat dissipating plate, and a condensing member mounted on the circuit board and disposed around the light emitting diode; and a driving unit disposed fixedly in the housing, connected electrically to the circuit board, and coupled electrically to an external power source for activating the light emitting diodes. A seal washer is disposed among and abuts against the housing, a transparent plate in front of the lighting units, and an annular cap mounted on the front end of the housing, so as to establish a liquid-tight seal thereamong.

3 Claims, 3 Drawing Sheets

WATER-RESISTANT ILLUMINATION APPARATUS

BACKGROUND OF THE INVENTION

1. Field of the Invention

The invention relates to an illumination apparatus, more particularly to a water-resistant illumination apparatus.

2. Description of the Related Art

A conventional water-resistant illumination apparatus for machining equipment includes a fluorescent lamp. However, the fluorescent lamp has a shorter service life as a result of its high heat generation and power consumption, and light generated by the fluorescent lamp is not effectively condensed.

SUMMARY OF THE INVENTION

Therefore, the object of the present invention is to provide a water-resistant illumination apparatus that has a superior heat dissipating capability and a longer service life and that can achieve high-brightness illumination.

According to the present invention, an illumination apparatus comprises:

a tubular housing made of a heat conductive material, configured with a receiving space, and having an open front end, and a closed rear end opposite to the front end in an axial direction of the housing;

a lighting device disposed in the receiving space in the housing, the lighting device including a heat dissipating plate positioned in the housing and disposed adjacent to the front end of the housing, the heat dissipating plate having a mounting surface that faces the front end of the housing, a circuit board in thermal contact with the mounting surface of the heat dissipating plate, a plurality of lighting units, each of which has a light emitting diode mounted on the circuit board, and a condensing member mounted on the circuit board and disposed around the light emitting diode, and a driving unit disposed fixedly in the housing, connected electrically to the circuit board, and adapted to be coupled electrically to an external power source for activating the light emitting diodes of the lighting units;

a transparent plate disposed in the housing and in front of the lighting units;

an annular cap mounted on the front end of the housing and extending into the receiving space; and a seal washer disposed among and abutting against the housing, the transparent plate and the cap so as to establish a liquid-tight seal thereamong.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
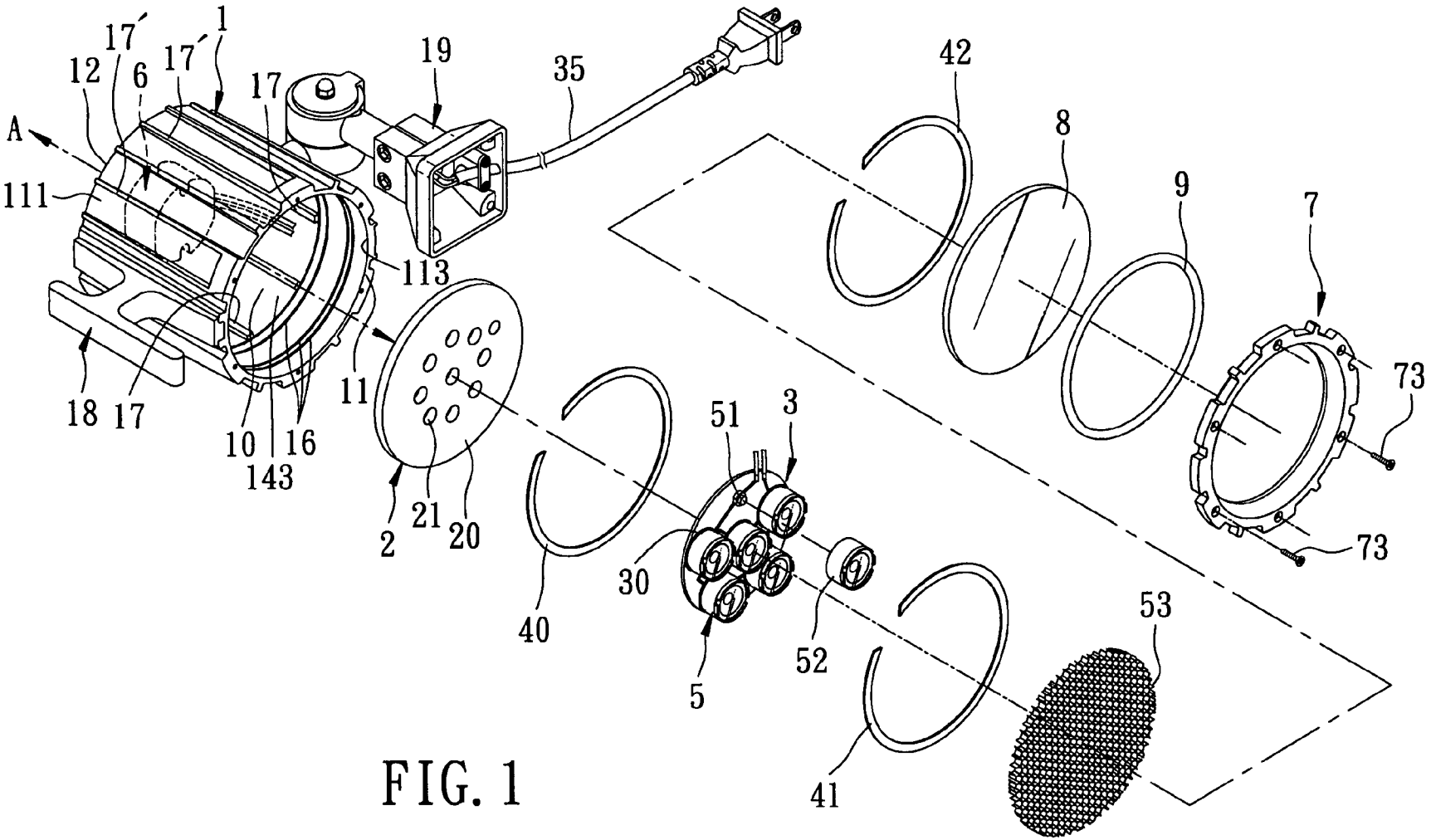
FIG. 1 is an exploded perspective view showing the preferred embodiment of an illumination apparatus according to the present invention.
Figure 2:
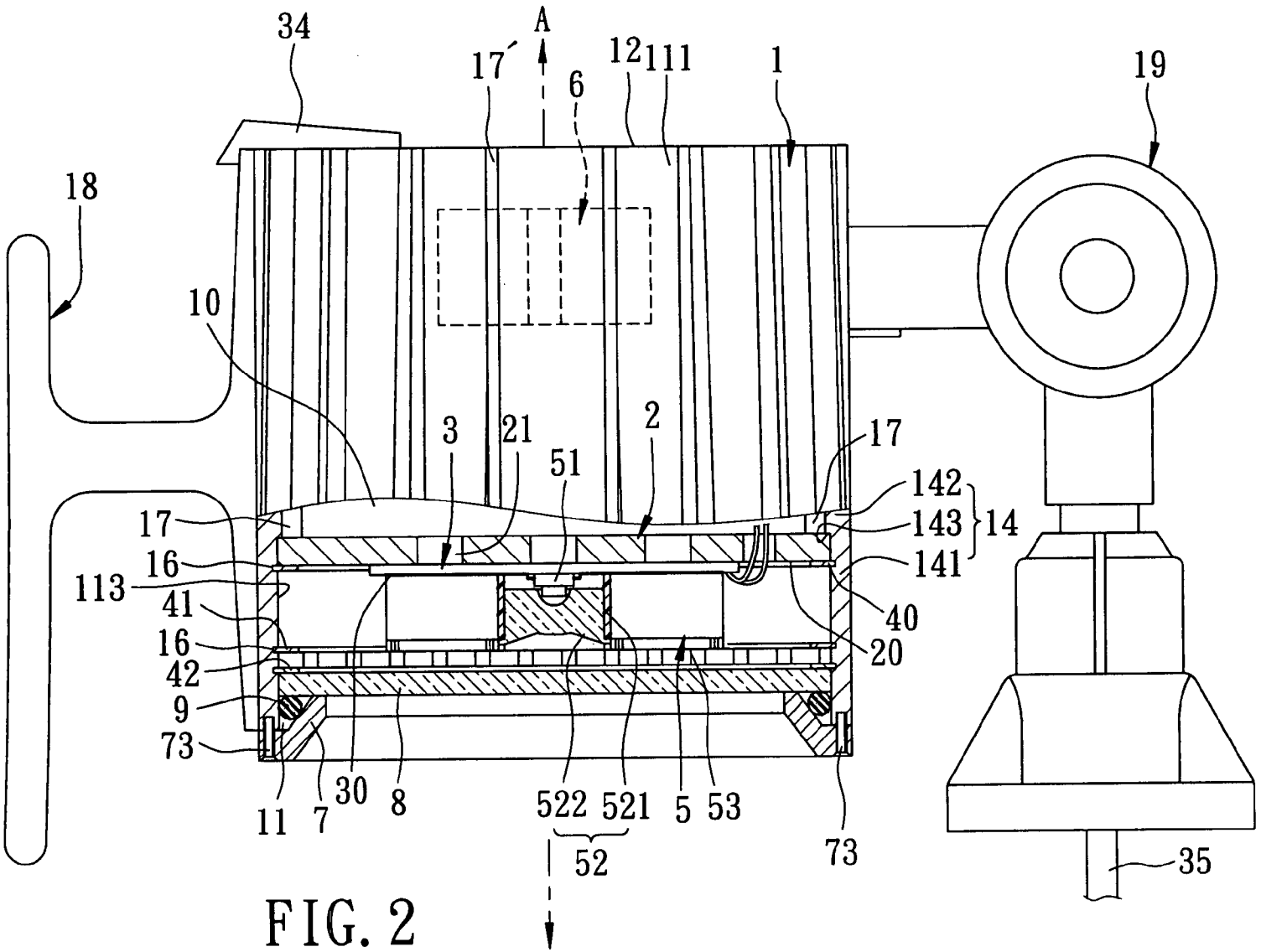
FIG. 2 is a partly sectional schematic view of the preferred embodiment.
Figure 3:
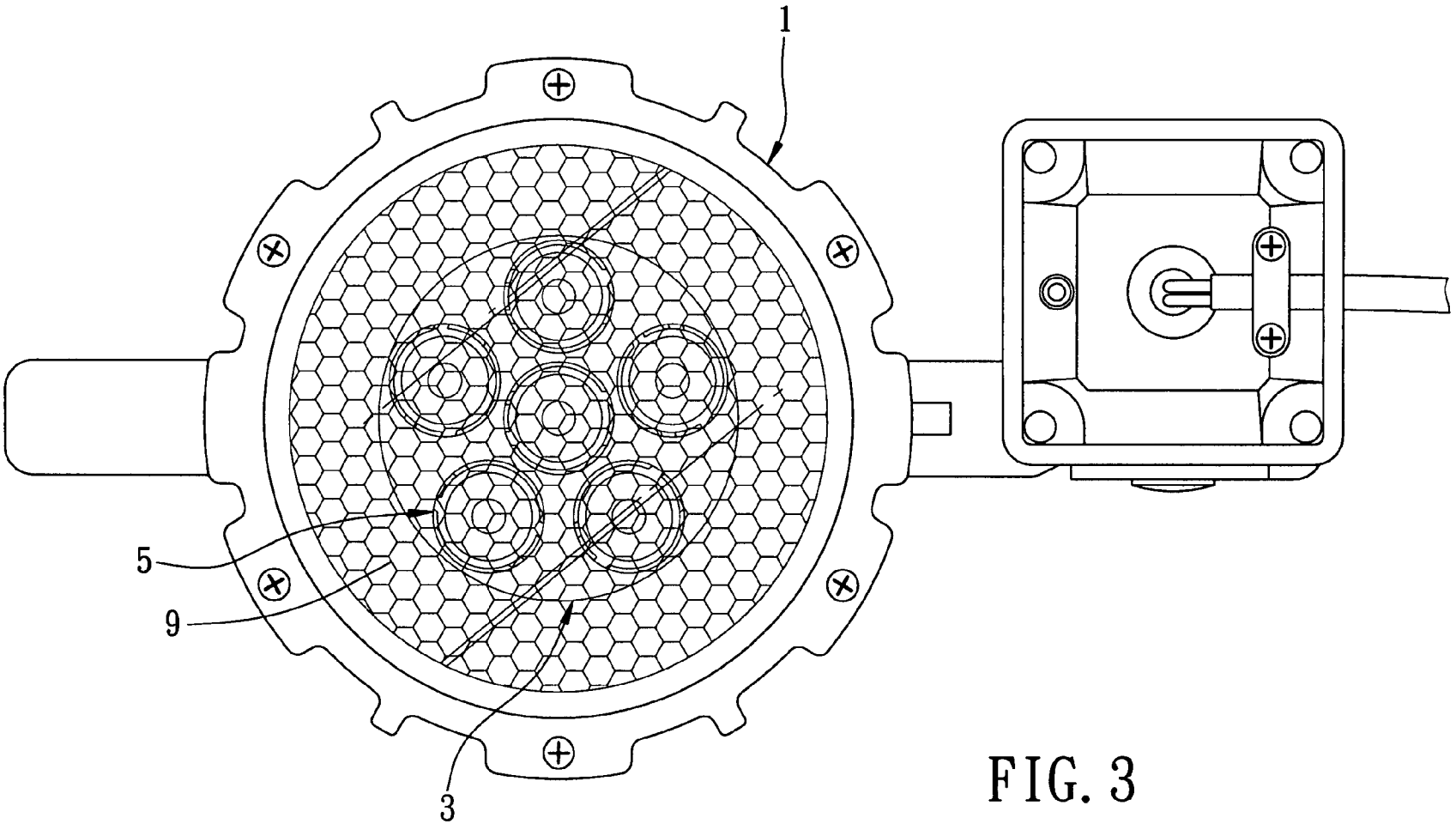
FIG. 3 is a schematic front view of the preferred embodiment.

Referring to FIGS. 1 to 3, the preferred embodiment of an illumination apparatus according to the present invention is shown to include a tubular housing 1, a lighting device, a transparent plate 8, an annular cap 7, and a seal washer 9.

The housing 1 is made of a heat conductive material, is configured with a receiving space 10, and has an open front end 11, and a closed rear end 12 opposite to the front end 11 in an axial direction (A) of the housing 1. In this embodiment, the housing 1 includes a tubular body 14, and a rear wall connected to a rear end of the tubular body 14. The tubular body 14 has a front end portion 141, a rear end portion 142 having an inner diameter smaller than that of the front end portion 141, and an intermediate shoulder portion 143 interconnecting the front and rear end portions 141, 142. The front end portion 141 of the tubular body 14 has an annular inner surface 113 formed with three annular engaging grooves 16 arranged spacedly apart from each other in the axial direction (A). Three C-shaped positioning rings 40, 41, 42 engage respectively the annular engaging grooves 16. The rear end portion 142 of the tubular body 14 has an inner surface formed with a plurality of heat-dissipating ribs 17 extending in the axial direction (A). Also, the tubular body 14 of the housing 1 has an outer surface 111 formed with a grip 18, and a plurality of heat-dissipating ribs 17' extending in the axial direction (A). An adjustable supporting frame 19 is adapted to support the housing 1.

The lighting device is disposed in the receiving space 10 in the housing 1, and includes a heat dissipating plate 2, a circuit board 3, a plurality of lighting units 5, and a driving unit 6.

The heat dissipating plate 2 is made of aluminum, and is disposed adjacent to the front end 11 of the housing 1. In this embodiment, the heat dissipating plate 2 is positioned between and abuts against the intermediate shoulder portion 143 of the tubular body 14 and the positioning ring 40. The heat dissipating plate 2 has a mounting surface 20 that faces the front end 11 of the housing 1, and is formed with a plurality of through holes 21 for heat dissipation purposes.

The circuit board 3 is attached to the mounting surface 20 of the heat dissipating plate 2 by means of heat conductive glue so as to be in thermal contact therewith. The circuit board 3 is provided with a printed circuit thereon.

Each of the lighting units 5 has a light emitting diode 51, such as a high power light emitting diode, mounted on the circuit board 3, and a condensing member 52 mounted on the circuit board 3 and disposed around the light emitting diode 51. In this embodiment, for each lighting unit 5, the condensing member 52 has a hollow lens-mounting seat 521 disposed around the light emitting diode 51 and attached fixedly to the circuit board 3 by heat-conductive glue 30, and a condensing lens 522 mounted on the lens-mounting seat 521 and cooperating with the lens-mounting seat 521 so as to cover the light emitting diode 51 for condensing light generated thereby.

The driving unit 6 is disposed fixedly in the housing 1, is connected electrically to the circuit board 3 via wires passing through one of the through holes 21 in the heat dissipating plate 2, and is adapted to be coupled electrically to an external power source (not shown) by means of a power cord 35 for activating the light emitting diodes 51 of the lighting units 5 in a known manner.

A switch 34 is mounted on the rear wall of the housing 1, and is connected electrically to the driving unit 6 for controlling supply of electrical power thereto.

The transparent plate 8 is disposed in the housing 1 and in front of the lighting units 5. In this embodiment, the transparent plate 8 abuts against the positioning ring 42, as shown in FIG. 2.

The annular cap 7 is mounted on the front end 11 of the housing 1 by means of a plurality of screw fasteners 73, and extends into the receiving space 10.

A cellular grating plate 53 is disposed in the housing 1 and between the lighting units 5 and the transparent plate 8. In this embodiment, the grating plate 53 is positioned between the positioning rings 41, 42, as shown in FIG. 2.

The seal washer 9 is disposed among and abuts against the housing 1, the transparent plate 8 and the cap 7 so as to establish a liquid-tight seal thereamong.

The following are some of the advantages attributed to the illumination apparatus of the present invention:

1. Due to the presence of the heat dissipating plate 2 and the heat conductive housing 1, heat generated by the light emitting diodes 51 can be dissipated.

2. Due to the use of the high power light emitting diodes 25 having a service life of about 100,000 hours, the illumination apparatus of this invention has a longer service life as compared to the aforesaid conventional illumination apparatus.

3. Due to the presence of the condensing lenses 522 and the grating plate 53, the illumination apparatus can achieve high-brightness illumination.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. An illumination apparatus comprising:

a tubular housing made of a heat conductive material, configured with a receiving space, and having an open front end, and a closed rear end opposite to said front end in an axial direction of said housing;

a lighting device disposed in said receiving space in said housing, said lighting device including a heat dissipating plate positioned in said housing and disposed adjacent to said front end of said housing, said heat dissipating plate having a mounting surface that faces said front end of said housing, a circuit board in thermal contact with said mounting surface of said heat dissipating plate, a plurality of lighting units, each of which has a light emitting diode mounted on said circuit board, and a condensing member mounted on said circuit board and disposed around said light emitting diode, and a driving unit disposed fixedly in said housing, connected electrically to said circuit board, and adapted to be coupled electrically to an external power source for activating said light emitting diodes of said lighting units;

a transparent plate disposed in said housing and in front of said lighting units;

an annular cap mounted on said front end of said housing and extending into said receiving space; and a seal washer disposed among and abutting against said housing, said transparent plate and said cap so as to establish a liquid-tight seal thereamong.

2. The illumination apparatus as claimed in claim 1, further comprising a cellular grating plate disposed in said housing and between said lighting units and said transparent plate.

3. The illumination apparatus as claimed in claim 1, wherein said housing has an annular outer surface formed with a grip.

* * * * *